US007526215B2

(12) United States Patent
Moodie et al.

(10) Patent No.: US 7,526,215 B2
(45) Date of Patent: Apr. 28, 2009

(54) RESERVE LIFE RUN-ON FEATURE FOR CUSTOMER REPLACEABLE UNITS

(75) Inventors: Malcolm J. Moodie, Banbury (GB); Helen Frances Kirby, Letchworth Garden (GB); Timothy David Jonathan Spink, Welwyn (GB); Derek John Milton, Welwyn Garden (GB); Stephen John Abbott, Welwyn Garden (GB); Patrick Leo Hoover, Rochester, NY (US); Eugene J. Carle, Fairport, NY (US); Dennis J. Reed, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 234 days.

(21) Appl. No.: 11/657,813

(22) Filed: Jan. 25, 2007

(65) Prior Publication Data

US 2008/0181625 A1 Jul. 31, 2008

(51) Int. Cl.
*G03G 15/00* (2006.01)

(52) U.S. Cl. ..... 399/24

(58) Field of Classification Search ..... 399/8, 399/9, 24, 25, 26, 31; 358/1.14
See application file for complete search history.

(56) References Cited

U.S. PATENT DOCUMENTS 4,634,258 A 1/1987 Tanaka et al.
4,751,484 A 6/1988 Matsumoto et al.
4,774,544 A 9/1988 Tsuchiya et al.
4,961,088 A 10/1990 Gilliland et al.
5,049,898 A 9/1991 Arthur et al.
5,272,503 A 12/1993 LeSueur et al.
5,283,613 A 2/1994 Midgley, Sr.
5,428,378 A 6/1995 Murata et al.
5,636,032 A 6/1997 Springett
5,771,420 A * 6/1998 Suzuki et al. ..... 399/25
6,016,409 A 1/2000 Beard et al.
6,532,351 B2 3/2003 Richards et al.
6,546,212 B1 * 4/2003 Ogata et al. ..... 399/24
6,895,191 B2 5/2005 Rommelmann et al.
7,124,097 B2 10/2006 Claremont et al.
7,230,730 B2 * 6/2007 Owen et al. ..... 358/1.14
7,242,873 B2 * 7/2007 Saisu et al. ..... 399/12
2004/0090647 A1 5/2004 Beard et al.

OTHER PUBLICATIONS

U.S. Appl. No. 11/215,791, filed Aug. 30, 2005, Hamby et al.
U.S. Appl. No. 11/247,778, filed Oct. 11, 2006, Radulski et al.
U.S. Appl. No. 11/432,993, filed May 12, 2006, Anderson.

* cited by examiner

*Primary Examiner*—Hoan H Tran
(74) *Attorney, Agent, or Firm*—Fay Sharpe LLP

(57) ABSTRACT

A printer includes at least one replaceable module which is removable from the printer. A processor discontinues an operation of the printer when the processor determines that an end of life value for the replaceable module is reached unless an appropriate identifier is input which allows the operation of the printer to continue beyond the end of life value. The identifier may be provided by a supplier at the end of life point, provided that an order for a replacement module is received.

21 Claims, 2 Drawing Sheets

RESERVE LIFE RUN-ON FEATURE FOR CUSTOMER REPLACEABLE UNITS

CROSS REFERENCE TO RELATED PATENTS AND APPLICATIONS

The following copending applications, the disclosures of which are incorporated in their entireties by reference, are mentioned:

U.S. application Ser. No. 11/215,791, filed Aug. 30, 2005, entitled "CONSUMABLE SELECTION IN A PRINTING SYSTEM," by Eric Hamby, et al.;

U.S. application Ser. No. 11/247,778, filed Oct. 11, 2005, entitled "PRINTING SYSTEM WITH BALANCED CONSUMABLE USAGE," by Charles Radulski, et al.; and U.S. application Ser. No. 11/432,993, filed May 12, 2006, entitled "TONER SUPPLY ARRANGEMENT," by David G. Anderson.

BACKGROUND

The exemplary embodiment relates to the printing arts. It finds particular application in connection with a printer and a method for safely extending the designated life of a customer replaceable unit.

Electronic printing systems, such as printers, copiers, multifunction devices, and the like, typically employ an input terminal which receives images in digital form and conversion electronics for converting the image to image signals or pixels. The printing system may include a scanner for scanning image-bearing documents or be connected to a computer network which supplies the digital images. The signals are stored and are read out successively to a marking engine for formation of the images and transfer of the images to a print medium, such as paper.

In typical electrophotographic printing systems, for example, such as copy machines and laser beam printers, a photoconductive insulating member, such as a photoreceptor belt or drum, is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a marking material. Generally, the marking material comprises toner particles adhering triboelectrically to carrier granules, which is often referred to simply as toner. The developed image is subsequently transferred to the print medium, such as a sheet of paper. The fusing of the toner image onto paper is generally accomplished by a fuser which applies heat to the toner with a heated roller and application of pressure.

To facilitate replacement of components of a printing system which have an expected lifetime which is shorter than the expected lifetime of the printing system in which they are used, the components may be in the form of self-contained modules, often known as customer replaceable units (CRUs). Typical CRUs include imaging units, fuser units, marking material containers, such as toner cartridges, photoreceptor belts, and the like. The CRUs are designed to make the replacement of replaceable components easy for the end user to perform. CRUs typically have an end of lifetime (EOL) which may be based on the expected lifetime of the CRU, in terms of the number of prints made or other determinable parameter.

The EOL is generally based on prior experience and is selected to avoid the risk of a component reaching a state in which it may negatively impact image quality or printing capability, or cause damage to the printing system in which it is used. For example, wear on the photoreceptor drum or belt, which is typically related to the number of prints made, not only can result in visibly defective prints but may lead to damage of other components of the printing system, for example, causing a failure of the developer housing. The EOL for an imaging unit CRU, which includes a photoreceptor as well as other components, may therefore be selected to ensure that there is little or no risk of either of these events occurring. Fusers also tend to have a restricted lifetime because of the high temperatures used, particularly in color printing systems. Fusers can fail catastrophically or may suffer a partial failure leading to problems in other components of the printing system, such as causing paper jams due to inadequately fused toner. Stripper fingers can wear, leading to jams. Thus the EOL of a replaceable module is selected to avoid such occurrences. Once the EOL is reached, the printing system is automatically shut down.

Because many CRUs are expensive components, it is undesirable for a customer to have to keep a supply of CRUs on hand for replacement when an EOL is reached. Accordingly, printing systems are designed to provide the customer with a reorder message when the EOL is approaching, giving the customer the opportunity to order a CRU before the EOL is reached. However, if the customer fails to notice or ignores the message, or if there is a delay in shipment of the replacement CRU from a supply center, or a CRU does not reach the correct destination, when the EOL is reached the machine will cease functioning, often resulting in significant downtime or customer dissatisfaction.

INCORPORATION BY REFERENCE

The following references, the disclosures of which are expressly incorporated herein in their entireties by reference, are mentioned.

U.S. Pat. No. 4,634,258 discloses a color copying machine in which a plurality of toner supplies, each of a different color, can be called upon. Counters are provided for counting the number of copies provided with each color toner developer container.

U.S. Pat. No. 4,751,484 discloses a digital printing apparatus with a replaceable drum unit (i.e., photoreceptor). The behavior of a solenoid within the apparatus is monitored in conjunction with a timing switch, in order to measure the time of use of the drum unit.

U.S. Pat. No. 4,774,544 discloses an electrophotographic printer in which the number of image forming operations is maintained in memory within the machine.

U.S. Pat. No. 4,961,088 discloses using an electronically-readable memory permanently associated with a replaceable module which can be installed in a digital printer. The embodiment disclosed in this patent enables a printer to check an identification number of the module, to make sure the module is authorized to be installed in the machine, and also enables a count of prints made with the module to be retained in the memory associated with the module.

U.S. Pat. No. 5,049,898 discloses an ink-jet printhead cartridge having a memory element associated therewith. A datum characterizing the amount of ink in the cartridge at any time can be periodically updated to reflect use of ink during printing and can warn the user of an impending exhaustion of ink.

U.S. Pat. No. 5,272,503 discloses a replaceable cartridge for an electrophotographic printer, having a memory device associated therewith. The memory device stores a value which varies as a function of the usage of the cartridge, and this varying value causes a controller in the printing apparatus to adjust a selected operating parameter in accordance with the value, thus maintaining printing quality of the printing machine.

U.S. Pat. No. 5,283,613 discloses a substantially "tamper proof" electronically-readable memory for use in a replaceable print module. A count memory associated with a replaceable module maintains a one-by-one count of prints made with the module.

U.S. Pat. No. 5,428,378 discloses an ink-jet printing apparatus which is capable of determining the life of an installed printhead. The method relies on counting the number of print scans undergone by the printhead.

U.S. Pat. No. 5,636,032 discloses a system for monitoring the supplies of marking material within an electrophotographic or ink-jet printer. The system calculates a number of pixels being rendered in a present job and calculates an amount of marking material used to render the present job. The system also calculates a total area coverage to date for the marking material cartridge, and determines and displays an expected number of pages that the marking material cartridge can render.

U.S. Pat. No. 6,895,191 discloses verification of the correctness of a particular replacement module of a printing apparatus before the apparatus fully engages the replacement module.

U.S. Pat. No. 7,124,097 discloses a method for ordering one or more consumables for a device which includes selecting one or more of the consumables used in the device to order using the device and submitting the order for the selected consumables using the device to one or more suppliers.

Published Application No. 2004/0090647 discloses a printing apparatus which determines a threshold number of time units until the maximum use of a subsystem is reached, and upon reaching the threshold number, causes the printing apparatus to communicate a status message.

BRIEF DESCRIPTION

In accordance with one aspect of the exemplary embodiment, a printer includes at least one replaceable module which is removable from the printer. A processor has a first mode of operation which discontinues an operation of the printer when the processor determines that an end of life value for the replaceable module is reached and a second mode of operation which allows the operation of the printer to continue beyond the end of life value in response to the input of an identifier which the processor recognizes as invoking the second mode of operation.

In accordance with another aspect of the exemplary embodiment, a method of operating a printer includes storing an end of life value of a printing parameter for a replaceable module of a printer in memory. In a first mode, the method includes discontinuing an operation of the printer when the printing parameter reaches the end of life value. In a second mode, the method includes continuing the operation of the printer beyond the end of life value in response to the input of an identifier which is recognized as invoking the second mode of operation.

In accordance with another aspect of the exemplary embodiment, a method of operating a printer includes storing an end of life value of a printing parameter for a replaceable module of a printer in memory. A cumulative value of the printing parameter is incremented with a processor as the replaceable module creates prints. When the cumulative value of the parameter reaches a value which is close to the end of life value, a reorder notification is provided. If the replaceable module is not replaced before the cumulative value reaches the end of life value, the method includes determining whether an identifier has been input, and if the identifier has been input, permitting the replaceable module to continue to create prints until a reserve life value is reached.

DETAILED DESCRIPTION

Figure 1:
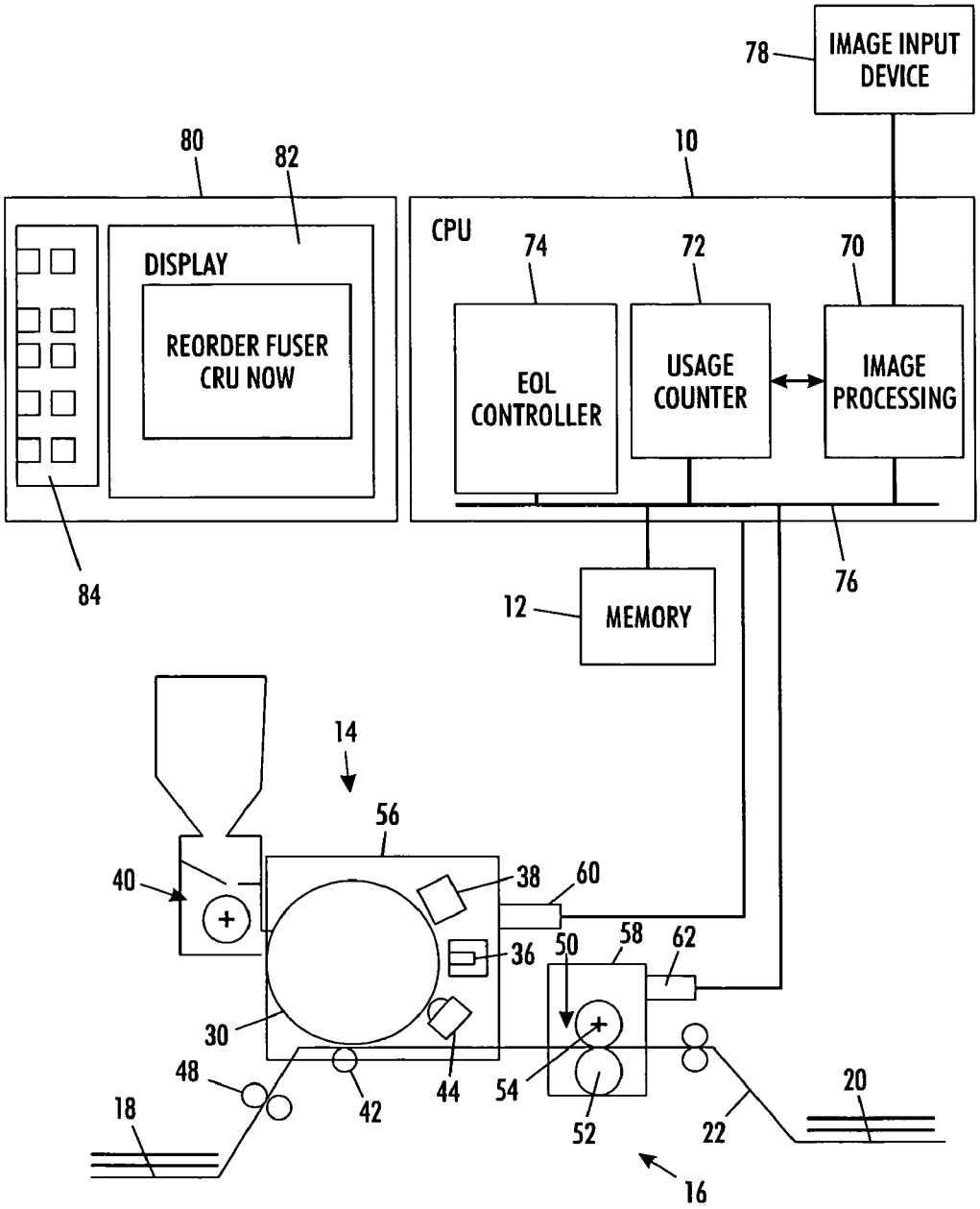
FIG. 1 is a schematic, partially elevational view of a printer in accordance with one aspect of the exemplary embodiment.

Aspects of the exemplary embodiment relate to a printer with a reserve life run on feature and to a method of operation of a printer with such a feature. The exemplary printer includes a processing component which permits a customer replaceable unit (CRU) to operate beyond a designated end of life event in response to the receipt of an identifier, such as a password. The exemplary method includes communicating an identifier to a user which, when input to the printer at an appropriate time, extends operation of the printer beyond the designated end of life event for a reserve life. The identifier may be issued to the user once an order for a replacement CRU has been placed.

The exemplary printer and method take advantage of the small leeway that is built into the designated end of life of a CRU to account for expected variability between printers and to provide a cushion against premature failures or the printer operating sub-optimally, leading to a general dissatisfaction with the machine. The exemplary printer and method of operation have advantages over a conventional printing system which creates a hard stop when a replaceable module reaches its designated end of life. The exemplary reserve life feature enables a limited extent of additional printing capability to be provided to a customer without seriously risking failure or damage of the printer. Additionally, it reduces the need for paying for the extra costs of special delivery shipment or having a service engineer deliver the replaceable module. When operating in the reserve life, there may be a loss in image quality or output, however, such a compromise is often more favorable to the customer than having no printing capability whatsoever.

As used herein a replaceable module or "customer replaceable unit" (CRU) can be any component of a printer which has an expected lifetime, until repair or replacement, which is shorter than the expected or actual lifetime of the printer in which it is to be used, or which has a designated lifetime. Generally, CRUs are self-contained, modular units which are easily replaced by a customer, often by simply removing the old CRU and plugging in a new one in the same location. Exemplary CRUs include imaging units and fuser units, although CRUs are not limited to these components and may include other components of a printer or even a subcomponent of a CRU, such as feed roll cartridges, fuser webs, stripper fingers, toner cartridges, developer housings, ozone filters, hole punch heads in the finisher, and the like.

A printer can be any device for rendering an image on print media, such as a copier, laser printer, bookmaking machine, facsimile machine, or a multifunction machine. The printer may be a xerographic (electrophotographic) printing system, an inkjet printing system, thermal printer, combination thereof, or the like. "Print media" can be a usually flimsy physical sheet of paper, plastic, or other suitable physical print media substrate for images. A "print job" or "document" is normally a set of related sheets, usually one or more collated copy sets copied from a set of original print job sheets or electronic document page images, from a particular user, or otherwise related. The operation of applying images to print media, for example, graphics, text, photographs, etc., is generally referred to herein as printing. The number of copies (prints) generally refers to the number of sheets printed with a particular replaceable module. Where both sides of the sheet are printed, each side is considered as a separate print. However, more complex measures of the number of copies may take into account overprinting and so forth.

A user can be any person who operates, repairs, manages, or otherwise interacts with the printer at the customer location where the printer is installed. As will be appreciated, the user who inputs the identifier may be a different person from the user who receives the identifier from the supply source when placing an order. Moreover, the user who is provided with instructions for obtaining the identifier may be a different person from the user who contacts the supplier, and so forth. For purposes of discussion, all these various persons will be considered as "the user."

The designated end of life (EOL) of a CRU is generally defined in terms of a predetermined event, such as a fixed number of copies printed by a printer after initial installation of the CRU in a printer. To provide for portability of CRUs between printers, CRUs may include a memory (a CRUM) which stores an end of life value of a parameter representing the predetermined end of life event. The end of life value is generally a maximum value (such as a maximum number of copies which can be printed), although in some cases, the end of life value may be a minimum value.

In another embodiment, the end of life value may be a function of pixel usage. This is a number, which represents the total cumulative usage of the particular module in terms of the number of pixels, or only print-black pixels, which have been printed by the module. Higher pixel coverage values indicate a relatively higher toner coverage of sheets passing through a particular module, and are generally an indication of how much physical wear is being experienced by the module. As will be appreciated, other end of life parameters or a combination of parameters which can be computed by the CPU 10, can be used as the cumulative value of the end of life parameter.

The CRUM also includes a counter which is incremented as the state of the printer changes (for example, by incrementing from zero, a number of copies made). Once the counter reaches the designated end of life value, the CRU has reached its EOL. Alternatively, the end of life value may be expressed in terms of a plurality of parameters. For example, the end of life value may be a function of two or more of the number of copies made, the toner coverage, the pixel count, and the like. When the computed value of the function reaches the end of life value, the CRU has reached its EOL. Since different replaceable modules have different wear patterns and different risks in the event of failure, the replaceable modules in any printing system may have different EOLs.

When the EOL occurs, or shortly before the EOL, an individual may telephone a supply center and place an order for a replacement CRU, or fill out and send an order form to the supply center, e.g., by fax, mail, or email, or otherwise place an order for the replacement CRU. In one embodiment, the individual may place the order for the replacement unit via the printer itself, such as through a graphical user interface linked via a wired or wireless link to a supply center for CRUs, as described, for example, in U.S. Pat. No. 7,124,097 to Claremont, et al., the disclosure of which is expressly incorporated herein in its entirety by reference. In the normal course, the order for the CRU is then filled and shipped to the user for installation in the printer.

The exemplary embodiment finds application in cases where, for some reason, the replacement CRU is not received and the EOL has occurred or is imminent. The replacement CRU may have not been received, for example, because an order was not placed, shipment has delayed delivery, the CRU was delivered to the wrong location, or for any other reason.

With reference to FIG. 1 a simplified, partially-elevational, partially-schematic view of an electrophotographic printer suitable for performing the method disclosed herein is shown. The printer includes a processor 10, such as a central processing unit (CPU), and a plurality of operating components under the control of the processor 10. The processor 10 may execute one or more programs of stored instructions for at least a portion of the method for extending the reserve life of the printer in accordance with one aspect of the exemplary embodiment described herein and illustrated in FIG. 2. In this particular embodiment, those programmed instructions are stored in memory 12, although some or all of those programmed instructions could be stored and retrieved from and also executed at other locations, such as in an operator system coupled to the printer. A variety of different types of memory storage devices, such as a random access memory (RAM) or a read only memory (ROM) in the system or a floppy disk, hard disk, CD ROM, or other computer readable medium which is read from and/or written to by a magnetic, optical, or other reading and/or writing system that is coupled to the processor 10, can be used for memory 12.

The illustrated operating components of the printer are shown in FIG. 1 as xerographic components, although it will be appreciated that in the case of an inkjet or other printing system the operation components will be suitably configured. The operating components include a marking engine 14, for applying images to print media, a fuser assembly 16, for permanently fixing the images to the print media, a paper source 18 for supply sheets of print media, a finisher 20, herein illustrated as paper trays, for receiving the printed and fused sheets, and a conveyor system 22, for conveying the print media from the paper source 18 to the marking engine 14, fuser assembly 16, and finisher 20 in turn. One or more of the operating components 14, 16, 18, 20, 22 comprises a replaceable module or CRU. In the illustrated embodiment, the printer includes two CRUs, specifically, an imaging unit 24, which includes one or more components of the marking engine 14, and a fuser unit 26, which includes one or more components of the fuser assembly 16.

The illustrated marking engine 14 includes a charge retentive surface, such as a rotating photoreceptor 30 in the form of a belt or drum. The images are created on a surface of the photoreceptor. Disposed at various points around the circumference of the photoreceptor 30 are a charging station 36 for each of the colors to be applied (one in the case of a monochrome printer, four in the case of a CMYK printer), such as a charging corotron, an exposure station 38, such as a raster output scanner (ROS), which forms a latent image on the photoreceptor 30, a developer unit 40, associated with each charging station for developing the latent image formed on the surface of the photoreceptor 30, a transferring unit 42, such as a transfer corotron, and a cleaning device 44. The imaging unit 24 may be a self contained module of the marking engine 14 and may include the photoreceptor 30. The imaging unit 24 may further include one or more of the charging station 36, exposure station 38, developer unit 40, transferring unit 42, and cleaning device 44. In the embodiment illustrated, the imaging unit 24 includes components 30, 36, 38, and 44. Paper or other print media is supplied to the marking engine 14 along a paper path from media supply trays of paper source 18. The paper is drawn from the supply trays, typically one sheet at a time, by feed rollers 48 of the conveyor system 22. The print media conveyor system 22 is controllable to acquire sheets of a selected print medium from the print media source 18, transfer each acquired sheet to the marking engine 14, to perform selected marking tasks, then to the fuser 16, and subsequently transfer each sheet to the finisher 20 to perform finishing tasks. Of course, in any particular embodiment of an electrophotographic printer, there may be variations on this general outline, such as additional corotrons, or cleaning devices, or, in the case of a color printer, multiple developer units.

The fuser assembly 16 includes elements for fusing the toner image to the print media. The fuser may include a pair of rollers 50, 52, at least one of which is driven, and which together define a nip. In the illustrated embodiment, roller 50 is a heat roller which is heated by a heater 54, such as a resistance heater, and roller 52 is a pressure roller which is biased into contact with heated roller 50. However, fusing systems based on pressure alone or other forms of electromagnetic radiation, such as UV radiation, are also contemplated. The fuser unit 26 may be a self contained module comprising one or more components of the fuser assembly 16, such as one or both of the rollers 50, 52 and heater 54.

The imaging unit 24 and fuser unit 26 may each be supported by a respective housing 56, 58, which is removably mounted to a chassis of the printer. In the illustrated embodiment, when the replaceable module 24 or 26 requires servicing or reaches its end of life, the module 24, 26 is simply removed in its entirety from the printer, and can then be immediately replaced by another module of the same type.

The printer executes print jobs. Print job execution involves printing images, such as selected text, line graphics, photographs, machine ink character recognition (MICR) notation, and the like on front, back, or front and back sides or pages of one or more sheets of paper or other print media. Some sheets may be left completely blank. Some sheets may have both color and monochrome images. Execution of the print job may also involve collating the sheets in a certain order. Still further, the print job may include folding, stapling, punching holes into, or otherwise physically manipulating or binding the sheets. The printing, finishing, paper handing, and other processing operations that can be executed by the printer are determined by the capabilities of the paper source 18, marking engine(s) 14, print media conveyor 22, and finisher 20 of the printer.

In a printing operation, the photoreceptor 30 rotates and is charged at the charging station 36. The charged surface arrives at the exposure station 38, where a latent image is formed. The portion of the photoreceptor 30 on which the latent image is formed arrives at the developer unit 40, which applies a marking material, comprising toner particles and associated carrier particles, to the latent image to obtain a toner image. The developed image moves with the photoreceptor 30 to the transferring unit 42, which transfers the toner image thus formed to the surface of a print media substrate, such as a sheet of paper, by applying a potential to the sheet. The sheet and image are conveyed away from the photoreceptor 30 to the fuser assembly 16, which fuses the image to the sheet. The fuser assembly 16 generally applies at least one of heat and pressure to the sheet to physically attach the toner and to provide a level of gloss to the printed media. Meanwhile, the photoreceptor 30 rotates to the cleaning device 44, which removes residual toner and charge from the photoreceptor 30, ready for beginning the process again. In general, the number of rotations of the photoreceptor 30 is proportional to the number of copies (prints) made, for example, each rotation of the photoreceptor drum may correspond to one copy (or other determinable number of copies).

The printer shown in FIG. 1 is an illustrative example. In general, any number of print media sources 18, marking engines 14, finishers 20, or other operating components can be connected together by a suitable print media conveyor system 22. In some embodiments, the printer may be a cluster of networked or otherwise logically interconnected printers each having its own associated print media source and finishing components.

In addition to the applicability to different replacement modules of an electrophotographic printer, the principles are also applicable to replacement modules of other types of printer. For example, in an ink jet printer employing liquid or solid inks (a hot melt device), the replaceable module may be one or more of a drive system for the printhead, the printhead itself, a transfer drum, drum motor, drum maintenance unit (DMU), or the like. Moreover, it is to be appreciated that a printer may include multiple marking engines under the control of a CPU 10 and that there may be a plurality of replaceable modules of the same type in a printer.

Each replaceable unit 24, 26 may include a customer replaceable unit monitor (CRUM) 60, 62, respectively, comprising memory that stores information pertaining to the respective replacement module 24, 26, as described more fully in U.S. Pat. No. 6,016,409 to Beard, et al., and U.S. Pat. No. 6,532,351, to Richards, et al., the disclosures of which are incorporated herein in their entireties by reference. Each CRUM 60, 62 is capable of retaining information for the particular replaceable module 24 or 26 about how that replaceable module is being used within a printer. Data is entered and retained on the CRUM and also periodically updated. Thus, if a particular replaceable module 24, 26 is removed from a printer, the information will stay with the replaceable module. By reading the data that is retained within a CRUM at a particular time, certain use characteristics of the replaceable module 24 or 26 can be discovered. In the exemplary embodiment, the CRUM memory stores the end of life value (e.g., maximum number of copies which can be printed with the respective replaceable module or maximum pixel usage) and the cumulative value which varies as a function of the usage of the CRU and which generally represents the current status of the replaceable module 24, 26 with respect to the end of life parameter. For example, the stored cumulative value may be the print count (the number of copies which have been created by a particular replaceable module 24 or 26, or the total pixel usage), periodically updated through the CPU 10.

In some embodiments, the CRUM 60, 62 may store multiple end of life values, each representing a different parameter, and multiple cumulative values, one for each of the end of life values. In this embodiment, the end of life of the module may occur when any of the cumulative values reaches the respective end of life value or when a function of two or more of the cumulative values reaches a predetermined value.

An exemplary CRUM 60, 62 comprises a 2K bit serial EEPROM (electrically erasable programmable read only memory) and may be connected with CPU 10 using a two-wire serial bus architecture. Each CRUM 60, 62 can serve as both a transmitter and receiver in the synchronous transfer of data with CPU 10 in accordance with a bus protocol. In particular, each CRUM 60, 62 may be capable of communicating with the CPU 10 at certain times during use of the printer so that the CPU 10 can read information from and write information to the CRUM memory for the respective replaceable module 24, 26, as described, for example, in U.S. Pat. No. 6,895,191 to Rommelmann, et al., incorporated herein by reference in its entirety. In particular, the CPU 10 reads the current status of the replaceable module 24, 26 from the CRUM 60, 62 and subtracts from (or adds to, where the end of life value is a minimum value) this number every time the CPU 10 causes a print to be output to generate a new cumulative value. Periodically, such as every five minutes or after every predetermined amount of time in which the machine is not outputting prints, the value of the print count is updated in the CRUM memory, e.g., by adding to the cumulative value the number of copies printed in a print job.

The cumulative value and maximum value of the end of life parameter stored in the CRUM 60, 62 are generally resistant to tampering, which prevents a customer from changing the end of life value or cumulative value to artificially extend the life of the CRU 24, 26. The end of life reserve feature of the present embodiment provides an override to the general rule when an identifier provided by the supply center is input to the CPU 10. In one embodiment the CRUM memory stores a reserve end of life value or information from which a reserve life value can be determined. The stored value or information may be accessible to the CPU once the identifier is input. In another embodiment, the CPU stores the reserve life value in memory 12 or includes processing instructions for determining an end of life value. Optionally, the new EOL may be written to the CRUM. Or, a flag may be set in the CRUM to indicate that the reserve life has been used.

The identifier may include a password, such as an alphanumeric code. In other embodiments, the identifier may comprise a sequence of events to be initiated by a user, e.g., in a specified order, such as opening and closing doors or trays of the printer. In yet another embodiment, the identifier may comprise an image in which a password is embedded. When the image is scanned by the printer, the CPU 10 recognizes the password embedded therein. The CPU 10 is configured to recognize a correct identifier for a replacement module 24, 26. In the case of a password, for example, the CPU 10 may store the value of the correct password in memory 12 or store information from which the password can be derived, e.g., based on such information as a numerical code assigned to the replacement module, a date, or combination of such information. In the case of an identifier which includes a sequence of events, the CPU 10 may include instructions for recognizing a sequence of sensed events as an identifier if the printer has been halted due to a replaceable module 24, 26 reaching its end of life value. Typically, components of the printers, such as doors included sensors so that the CPU 10 can identify when one of the doors is opened or closed. In general, the sequence of events which make up the identifier is one which is not typically detected in a printer, such as opening and closing the same door three times.

Since a primary object of the identifier is to encourage the user to place an order for a replacement module, it is not critical for the password or other identifier to be a completely tamperproof identifier. Indeed, the same identifier can be used for all replaceable modules 24, 26 in the printer and/or the same identifier may be utilized each time an end of life event occurs with a particular replaceable module 24 or 26. Since these events are relatively infrequent, a user is not likely to remember the password from a prior replacement and, even if he does, the benefit of entering the password without ordering a replacement unit is minimal, since the reserve life is relatively short in comparison with the typical lifetime of the replaceable module 24, 26.

The exemplary CPU 10 includes an image processing component 70, a counter 72 and an end of life controller 74, all in communication with memory 12 via a data/control bus 76. Memory 12, as noted above, stores a control program to control overall operation of the printer. The image processing component 70 receives an input print job comprising one or more images to be printed from an image input device 78. The image input device 78 can comprise a built-in optical scanner, which can be used to scan a document such as book pages, a stack of printed pages, or the like, to create a digital image of the scanned document that is reproduced by printing operations performed by the printer. Alternatively, a print job can be electronically delivered to an interface unit of the printer via a wired or wireless connection to a digital network that interconnects, for example, personal computers or other digital devices 78.

A graphical user interface 80 in communication with CPU 10 includes a display unit 82, such as an LCD screen, which displays notification messages to be viewable by the user, in response to a user command and/or the control of the CPU 10. In the exemplary embodiment, the graphical user interface 80 also allows a user to select printing/copying parameters, such as number of copies to be made. A user input device, such as touch screen 82 of the graphical user interface 80 or an associated keypad 84, enables a user to input an identifier for accessing the reserve life. Other user input devices, such as one or more of a keyboard, computer mouse, touch pad, or touch screen, either on the printer or linked thereto via a network, are also contemplated.

The image processing component 70 converts the received image to a form in which it can be rendered by the marking device 14, a process generally known as raster image processing in a xerographic device. In doing so, the image processing component 70 generates end of life information regarding one or more end of life parameters, such as the number of copies to be printed, the number of pixels to be printed, the amount of toner to be consumed, fuser operating parameters, or the like. The information may be stored in volatile memory 12. The information may be updated by new end of life information, e.g., as additional print jobs are received. The counter 72 increments the stored cumulative value of the end of life parameter, based on the information from the image processing component 70 which has been stored in memory 12 and stores the new cumulative value of the end of life parameter as well as the maximum value in memory 12. The end of life controller 74 periodically updates the cumulative value stored in the CRUM 60, 62 based on information from the counter 72.

The end of life controller 74 is in communication with the graphical user interface 80 for displaying notification messages on screen 82, e.g., a first notification message (a "reorder module" message) when the end of life of a replaceable module 24, 26 is close to being reached, e.g., from five to seven days prior to the estimated end of life or within a predetermined number of copies from the end of life number, and a second notification message when the end of life value is reached indicating that printing is no longer available. Additional notification messages may be provided, depending on user preferences, such as messages which provide a warning of an upcoming replacement in advance of the replacement notification and a warning of the impending hard stop one to two days prior to the expected end of life.

The end of life controller 74 also serves to disable printing functions when the end of life value is reached unless a password or other identifier extending the lifetime of the replaceable module 24 or 26 is entered. If a password is entered at an appropriate time, e.g., after the end of life has been reached, the end of life controller 74 is configured to permit the printer to continue printing for a reserve life.

The reserve life provides an extension of the lifetime of the replaceable module 24 or 26. The reserve life may be expressed in terms of a reserve life value. The reserve life value may be expressed in the same parameter used to define the end of life, e.g., a limited additional value of the parameter used to express the end of life value or a percentage thereof. Or the reserve life value may be expressed in a different parameter from that used to express the end of life value. In one embodiment, the reserve life value may be a predetermined additional number of copies which can be printed with the replacement module. For example, a printer may be allowed to print a maximum of an additional 5000 copies with the replaceable module 24, 26 in excess of the normal designated life. Or, the reserve life value may be a fixed duration, such as a predetermined number of days. In general, the reserve life value is only a small proportion of the end of life value, such as 10% or less. In one embodiment, the reserve life value may be selected to provide sufficient time for a new replaceable module 24, 26 to arrive from the supplier, which may be of the order of two to seven days. In general, the reserve life value provides a finite reserve life based on usage of the replaceable module, as for the end of life value.

In yet another embodiment, the reserve life need not be fixed by any parameter but is associated with progressively increasing constraints on the operation of the printer which make it increasingly desirable for the user to install a replacement module. The constraints may result in a slowing the printing speed, reduction of the fuser temperature, or other constraints which typically motivate the customer to replace the module.

The processing components 70, 72, 74 of the printer CPU 10 may all execute instructions stored in memory 12. As will be appreciated, components 70, 72, 74 may be combined or split into separate components and need not all be located within a single CPU 10.

Figure 2:
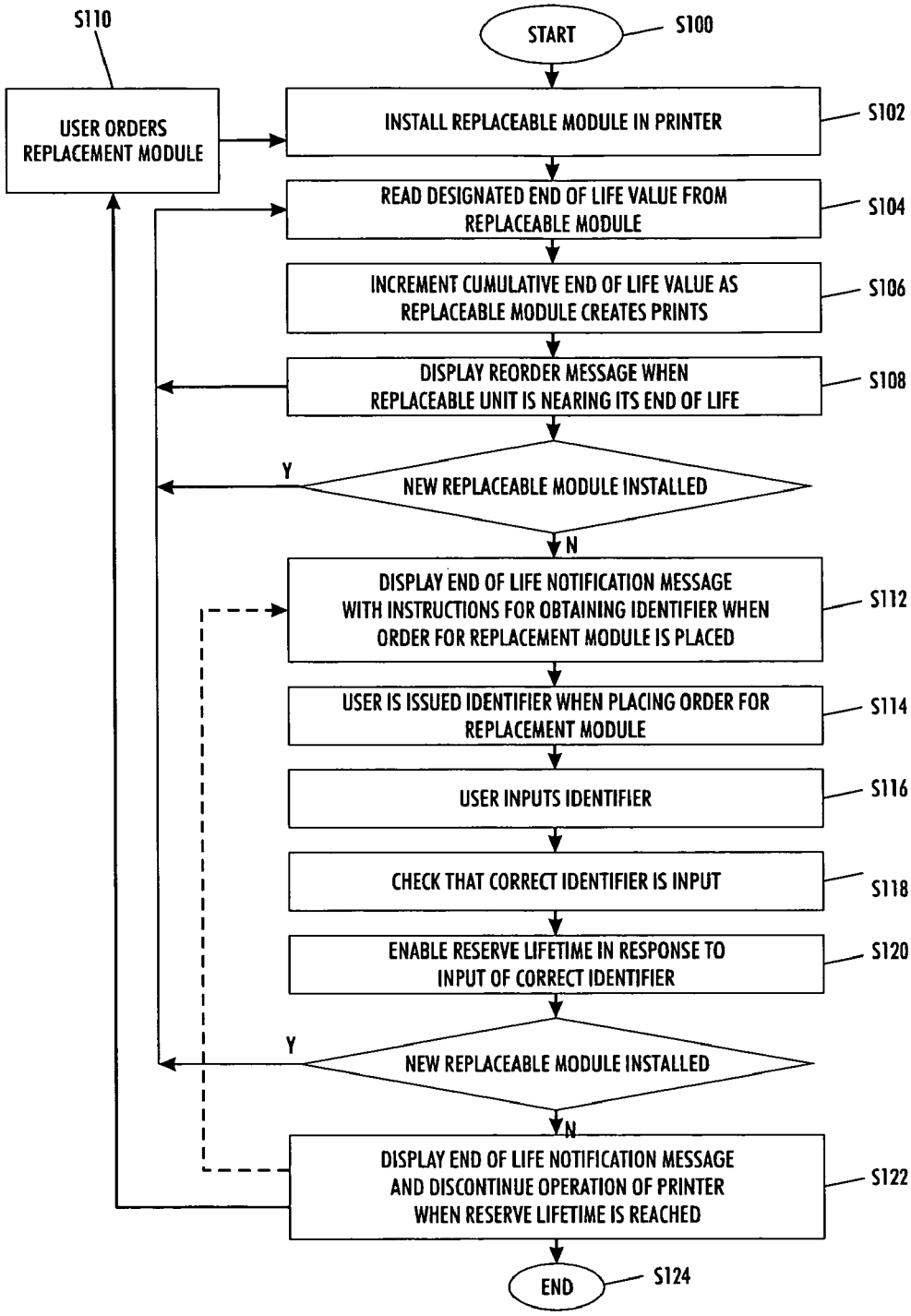
FIG. 2 is a flow diagram of a method of operating a printer in accordance with another aspect of the exemplary embodiment.

FIG. 2 illustrates an exemplary method of operating a printer, such as that shown in FIG. 1, which enables extending the life of a replaceable module 24, 26 of the printer beyond its end of life value. It will be appreciated that the method may include fewer, more or different steps from those illustrated and that the method need not proceed in the order illustrated. The method begins at step S100. At step S102, a replaceable module is installed in the printer. The replaceable module 24, 26 may be installed by the manufacturer or may have been subsequently installed by a user of the printer. At step S104, the end of life controller 74 reads the designated end of life value and cumulative value stored in the CRUM 60, 62 and stores the values in memory 12. At step S106, as each print job is received and printed by the printer, the end of life controller 74 increments the stored cumulative value of the end of life parameter, based on the information from the processing component which has been stored in memory 12, and stores the new cumulative value of the end of life parameter as well as the maximum value in memory 12. The end of life controller 74 also updates the cumulative value stored in the CRUM 60, 62. At step S108, when the cumulative value of the end of life parameter of a particular replaceable module 24 or 26 is close to its maximum value, a reorder notification may be provided to alert a user that it is time for a replacement module to be ordered. In one embodiment, the end of life controller 74 causes the GUI 80 to display the notification message advising the user that it is time to order a replacement replaceable module 24, 26. In the normal course, a user observing the message, or being informed of it by another user, orders a replacement module 24, 26 at step S110, and installs the replacement module when it arrives, the method returning once more to step S102 with the new replaceable module. The processor 10 reads the end of life value and cumulative value stored in the replaced module and resets the stored values in memory 12.

In another embodiment, where the printer is connected with a network, the CRUM 60, 62 and/or CPU 10 may automatically send a request to re-order a replacement module through the network or over a phone line to the manufacturer, in a manner which is invisible to the user.

In normal operation, the replacement CRU is received and installed at the appropriate time, e.g., at the EOL. Some printers may permit replacement before the EOL while others may not permit the replacement CRU to be installed until the EOL is reached.

However, if a replacement CRU is not installed, the end of life controller 74 continues to increment the cumulative value of the end of life parameter as printing is performed. At step S112, when the cumulative value reaches the end of life value, the end of life controller 74 causes the display 82 to display an end of life message and, in its normal operating mode, may discontinue an operation of the printer, e.g., shut down the printer, disable printing, or disable specific functions of the printer associated with the replaceable module 24 or 26 which has reached its end of life. At step S112, the end of life controller 74 may also cause the display 82 to provide instructions for obtaining a password for extending the life of the replaceable module 24, 26 to provide time for a replacement module to be obtained. The instructions may inform a user that a limited extension to the life of the module may be obtained when a replacement module is ordered. Alternatively, the information may be provided to the user by the supply center when the user contacts the supply center for obtaining a replacement module. In yet another embodiment, where the printer is connected with a network, the CPU 10 may send the notification regarding the extension to a user's PC.

At step S114, the user may place an order for a replacement CRU and is provided with a password or other identifier. In general, a password is only issued to the user by the supply center if an order is in the process of being or has been placed.

At step S116, the user enters the password via the user interface or otherwise inputs the identifier to the printer.

At step S118, the end of life controller 74 detects that an identifier has been entered and confirms that it is correct. In particular, the end of life controller 74 identifies the password input by a user as one which invokes a second mode of operation in which the printer is permitted to operate beyond the designated end of life value. In one embodiment, the second mode is invoked only if the end of life has been reached.

As step S120, the CPU 10 enables the printer to continue operation for a reserve life. In one embodiment, the end of life controller 74 increments the stored end of life value in memory 12 or otherwise provides for the designated end of life value to be extended by up to the predetermined reserve life value. The printer is allowed to continue operation until the reserve life value is reached. Assuming that a new replacement CRU 24, 26 is received and installed before the reserve life value is reached, the method returns to step S104. At step S122, if the replacement module has not been installed by the time the reserve life expires, the end of life controller 74 may cause the display 82 to display an end of life message and may discontinue an operation of the printer in a similar manner to step S112. The method ends at step S124.

In some embodiments, the user is permitted to extend the life for a particular replacement module 24, 26 only once. Thus, if a user enters the password when the reserve life is at an end, it is not accepted by the CPU 10.

In other embodiments, a second reserve life may be permitted when the end of the reserve life is reached. To minimize the possibility of damage to the printer, the printer may be run in a safe mode, for example, limiting the operating speed of the printer, lowering the fuser operating temperature, placing a limit on the number of copies which may be printed in a designated time period, or adjusting other operating parameter which is designed to prolong the actual life of the replaceable module, when the module has exceeded its designated end of life (either during the first reserve life or in a subsequent extension).

In some embodiments, if two replaceable modules reach their end of life, only one of the passwords for those replaceable modules is accepted. Or, if two passwords are accepted, the processor ensures that the two reserve lives run concurrently. In the latter case, if the first of the reserve lives expires before the associated replaceable module is replaced, the printer operation is halted until that module is replaced. The printer may then continue until the remainder of the reserve life for the second module expires.

In one embodiment, the CPU 10 is configured such that a password is not accepted (i.e., no reserve life is authorized) until the replacement module associated with the password reaches its designated end of life. This is intended to reduce the risk that a customer may attempt to circumvent the normal reorder process to obtain a reserve life with every CRU. Thus, if a user represents to the supply center that the end of life has been reached and is given a password prior to the end of life, the password will not be accepted by the processor 10 until the end of life value has been reached. In one embodiment, the end of life is considered to be reached when the cumulative value reaches the end of life value. In another embodiment, the end of life is considered to be reached, if the cumulative value is very close to the end of life value, such as a value which is closer to the end of life value than it is to the value which prompted the display of a reorder notification.

The determination of the appropriate time to display the reorder notice (step S108) can be based on a predicted behavior of the printer. For example, the processor may compute an appropriate prompt time based on usage. The notice may be then displayed about a week or other suitable time period before the designated end of life value is expected to be reached. In one embodiment, the CPU 10 stores an average daily print volume for the printer in memory 12 and/or at a predetermined location within the CRUM memory. This may represent the number of prints that have been made with the module divided by a certain number of days, such as the previous ten days or month. Based on the average daily print volume, the CPU 10 computes an expected end of life and a time to display the reorder message. Alternatively, the notice may be displayed when the replaceable module 24 or 26 cumulative value reaches a predetermined percentage of the end of life value, such as 90% or 95%. For example, if the end of life value is 100,000 prints, the notice may be displayed at about 90,000 prints, representing 90% of the designated life.

The computer implemented steps of the disclosed method may be readily implemented as software executed on a programmed general purpose computer, a special purpose computer, a microprocessor, or the like. In this case, the methods and systems of the exemplary embodiments described herein can be implemented as a routine embedded on a microprocessor such as Java® or CGI script, as a resource residing on a server or graphics work station, as a routine embedded in a dedicated print management system, web browser, web TV interface, PDA interface, or the like. The end of life controller and methods for its operation can also be implemented by physically incorporating the system and method into a software and/or hardware system, such as the hardware and software of a dedicated print management system.

In one embodiment, the computer implemented steps of the method illustrated in FIG. 2 (e.g., steps S104, S106, S108, S112, S118, S120, and S122) may be implemented in a computer program product that may be executed on a computer. The computer program product may be a tangible computer-readable recording medium on which a control program is recorded, such as a disk, hard drive, or may be a transmittable carrier wave in which the control program is embodied as a data signal. Common forms of computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, transmission media, such as acoustic or light waves, such as those generated during radio wave and infrared data communications, and the like, or any other medium from which a computer can read and use.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printer comprising:

at least one replaceable module which is removable from the printer; and a processor having a first mode of operation which discontinues an operation of the printer when the processor determines that an end of life value for the replaceable module is reached and a second mode of operation which allows the operation of the printer to continue beyond the end of life value in response to the input of an identifier which the processor recognizes as invoking the second mode of operation, the identifier comprising a password.

2. The printer of claim 1, further comprising a graphical user interface in communication with the processor which displays instructions to a user for obtaining the identifier.

3. The printer of claim 2, wherein the graphical user interface is configured for communicating the identifier to the processor in response to user inputting the identifier to the graphical user interface.

4. The printer of claim 1, wherein the end of life value comprises a maximum number of prints to be created by the replaceable module in the first mode of operation.

5. The printer of claim 4, wherein in the second mode of operation, the processor allows a limited number of prints in excess of the maximum number of prints.

6. The printer of claim 1, wherein the replaceable module comprises at least one of an imaging unit and a fuser unit.

7. The printer of claim 1, wherein the replaceable module comprises a memory which stores the end of life value.

8. A printer comprising:

at least one replaceable module which is removable from the printer; and a processor having a first mode of operation which discontinues an operation of the printer when the processor determines that an end of life value for the replaceable module is reached and a second mode of operation which allows the operation of the printer to continue beyond the end of life value in response to the input of an identifier which the processor recognizes as invoking the second mode of operation; and a graphical user interface in communication with the processor which displays instructions to a user for obtaining the identifier, the instructions displayed requiring that the user places an order for a replacement replaceable module for the identifier to be communicated to the user.

9. The printer of claim 8, wherein the identifier comprises a password.

10. A printer comprising:

at least one replaceable module which is removable from the printer; and a processor having a first mode of operation which discontinues an operation of the printer when the processor determines that an end of life value for the replaceable module is reached and a second mode of operation which allows the operation of the printer to continue beyond the end of life value in response to the input of an identifier which the processor recognizes as invoking the second mode of operation, wherein the processor does not accept the identifier as invoking the second mode until the end of life value is reached.

11. A method of operating a printer comprising:

storing an end of life value of a printing parameter for a replaceable module of a printer in memory;

in a first mode, discontinuing an operation of the printer when the printing parameter reaches the end of life value;

in a second mode, continuing the operation of the printer beyond the end of life value in response to the input of an identifier which is recognized as invoking the second mode of operation, the identifier being provided to a user when a replacement replaceable module is ordered.

12. The method of claim 11, wherein the method further comprising providing instructions to a user for obtaining the identifier when the end of life value is reached.

13. The method of claim 11, further comprising, in the first mode, incrementing the printing parameter as the replaceable module creates prints.

14. The method of claim 11, wherein the method further comprises receiving the identifier from a user via a graphical user interface associated with the printer.

15. The method of claim 11, wherein the end of life value comprises a maximum number of prints to be created by the replaceable module in the first mode of operation.

16. The method of claim 15, wherein in the second mode of operation, only a limited number of prints in excess of the maximum number of prints is permitted to be printed.

17. The method of claim 11, wherein the replaceable module comprises at least one of an imaging unit and a fuser unit.

18. A method of operating a printer comprising:

storing an end of life value of a printing parameter for a replaceable module of a printer in memory;

in a first mode, discontinuing an operation of the printer when the printing parameter reaches the end of life value;

in a second mode, continuing the operation of the printer beyond the end of life value in response to the input of an identifier which is recognized as invoking the second mode of operation, the second mode being invoked only when the end of life value is reached.

19. A computer program product which stores instructions for implementing the method of claim 18.

20. A printer comprising a processor which implements the method of claim 18 and at least one replaceable module.

21. A method of operating a printer comprising:

storing an end of life value of a printing parameter for a replaceable module of a printer in memory;

incrementing a cumulative value of the printing parameter with a processor as the replaceable module creates prints;

when the cumulative value of the parameter reaches a value which is close to the end of life value, providing a reorder notification;

requiring that a user places an order for a replacement replaceable module for an identifier to be communicated to the user; and if the replaceable module is not replaced before the cumulative value reaches the end of life value, determining whether the identifier has been input, and if the identifier has been input, permitting the replaceable module to continue to create prints until a reserve life value is reached.

* * * * *